US005280263A

United States Patent [19]

Sugaya

[11] Patent Number: 5,280,263

[45] Date of Patent: Jan. 18, 1994

[54] PTC DEVICE

[75] Inventor: Shoichi Sugaya, Tokyo, Japan

[73] Assignee: Daito Communication Apparatus Co., Ltd., Tokyo, Japan

[21] Appl. No.: 785,316

[22] Filed: Oct. 30, 1991

[30] Foreign Application Priority Data

Oct. 31, 1990 [JP] Japan ..... 295195

[51] Int. Cl.[5] ..... H01C 7/10

[52] U.S. Cl. ..... 338/22 R; 338/22 SD; 252/502

[58] Field of Search ..... 338/22 R, 22 SD; 264/105, 104; 252/511, 502, 512

[56] References Cited

U.S. PATENT DOCUMENTS 4,545,926 10/1985 Fouts, Jr. et al. ..... 252/511
4,560,524 12/1985 Smuckler ..... 264/105
4,910,389 3/1990 Sherman et al. ..... 252/511 X

FOREIGN PATENT DOCUMENTS 60-190469 9/1985 Japan .
61-064758 4/1986 Japan .
2-017609 1/1990 Japan .
1605005 12/1981 United Kingdom .

*Primary Examiner*—Marvin M. Lateef
*Attorney, Agent, or Firm*—Thomas R. Morrison

[57] ABSTRACT

A PTC element displaying low volume resistivity and excellent PTC characteristics contains conductive carbonaceous particles having a large particle size, small specific surface area and being essentially unstructured such particles being, for example, thermal black or mesocarbon microparticles. The conductive particles are heat treated in an inactive atmosphere, blended with a crystalline polymer and then cross-linked by gamma radiation. In a variant form, the polymer can be chemically grafted onto the particles. The very low resistivity and excellent PTC characteristics of this PTC device make it suitable for miniaturization.

19 Claims, 11 Drawing Sheets

PTC DEVICE

BACKGROUND OF THE INVENTION

The present invention relates to an overcurrent protection PTC element having a positive temperature coefficient (PTC) that increases its resistance drastically in a certain range of temperature.

The use of PTC devices to control current flow in an electrical circuit and compensate for the effects of temperature is known. An example of conventional PTC elements, Japanese Patent Publication No. 33707/1975 discloses a temperature-sensitive conductive composition wherein carbon black powder having a generally spherical particle shape and an average particle diameter of 0.08μ–200μ is blended with crystalline polymer. The publication teaches that a PTC element using large, spherical conductive carbon black particles exhibits excellent PTC characteristics even in a low resistance range.

Japanese Patent Publication No. 3322/1989 discloses an electrical circuit protection device wherein carbon black blended with crystalline polymer has particle diameter (D) of 20 mμ–150 mμ with the ratio S/D of specific surface area S ($m^2/g$) to particle diameter D (mμ) being not more than 10. This publication teaches that it is desirable to use carbon black with a particle diameter of less than 100 mμ, because carbon black of large particle diameter makes it difficult to obtain a PTC composition that has both low volume resistivity and sufficient PTC characteristics.

Japanese Patent Publication Laid-Open No. 80201/1985 discloses a conductive material with heat sensitive resistance which is a mixture of a crystalline polymer and a carbon black having an average particle size of less than 0.08μ, the carbon black having a weight of between about 25 to about 60% of the crystalline polymer. This publication teaches that carbon black with average particle diameter more than 0.08μ is not desirable because the resistance value of a conductive material with heat sensitive resistance using such would be too high in the normal temperature range.

When voltage decrease in a circuit is considered, it is desirable for an overcurrent protection element to have low resistance value and also because of the recent trend for making electrical devices compact and using high density circuits, such element should be small in size.

Where a PTC composition is used to make a small, low resistance overcurrent protection element, the volume resistivity of the PTC composition must be low.

Dispersing conductive particles in polymer is a known method for making a polymer conductive, and if conductive carbon black, such as Ketjen Black EC (manufactured and sold under that name by Nippon EC Co., LTD.), is used for that purpose, a very low resistance value is possible. However, this type of composition cannot be used for overcurrent protection, because its resistance value increases very little relative to its initial resistance at normal operating temperatures, even in its maximum PTC range. The reason for this is thought to be that because the conductive particles are small, their specific surface area is large, causing them to aggregate with such strength as makes it difficult for them to disperse evenly in a polymer. Unevenly dispersed carbon black particles form continuous conductive paths in the polymer and while this improves conductivity of the material, it makes it impossible to effectively separate the carbon black particles in these conductive paths from each other during polymer thermal expansion so that proper PTC characteristics cannot be achieved.

The carbon black described in the Japanese Patent Publication No. 3322/1989 and Japanese Patent Publication Laid-Open No. 80201/1985 is of smaller particle size and larger in specific surface area than that of the Ketjen Black EC previously described conductive carbon black. Nonetheless some dispersion of such throughout a polymer is possible. However, when the amount of carbon black is increased to reduce the volume resistivity of the PTC composition, there unavoidably occurs the formation of continuous conductive paths which are not broken during thermal expansion. As a result, the more that volume resistivity is reduced, the smaller the PTC characteristics become, making it impossible to maintain the PTC characteristics necessary for overcurrent protection.

Japanese Patent Publication No. 33707/1975 states that it is possible to obtain a PTC composition having low resistance value and superior characteristics by using carbon black made of generally spherical particles having average particle sizes a range of about 0.08μ to about 200μ. It seems that such conductive particles are easily dispersed in polymer and effectively separated at the time of thermal expansion of the polymer. However, the performance of a PTC composition using such conductive particles is no better than those disclosed in Japanese Patent Publication No. 3322/1989 and Japanese Patent Publication Laid-Open No. 80201/1985.

It is clear that whenever conductive particles as described in Japanese Patent Publication No. 33707/1975, Japanese Patent Publication No. 3322/1989 or Japanese Patent Publication Laid-Open No. 80201/1985 are used for a PTC element, there is a limitation in how small the PTC element can be made and how far the resistance value can be lowered.

OBJECTS AND SUMMARY OF THE INVENTION

It is therefore an object of the present invention to provide a PTC element in a PTC device that overcomes the drawbacks of the prior art. It is a further object of the present invention to provide a PTC element that exhibits superior PTC characteristics in the low volume resistivity range required for miniaturization and resistance reduction of the PTC element.

Briefly stated, there is provided a PTC element that displays low volume resistivity and excellent PTC characteristics contains conductive carbonaceous particles having a large particle size, small specific surface area and being essentially unstructured such particles being, for example, thermal black or mesocarbon microbeads. The conductive carbonaceous particles are heat treated in an inactive atmosphere, blended with a crystalline polymer and then cross-linked by gamma radiation. In a variant form, the polymer can be chemically grafted onto the particles. The very low resistivity and excellent PTC characteristics of this PTC device make it suitable for miniaturization.

In accordance with an embodiment of the device, there is provided in a PTC device, a PTC element comprised of a crystalline polymer mass having essentially unstructured conductive carbonaceous particles dispersed therethrough, the conductive carbonaceous particles being separable one from another upon thermal expansion of the polymer, and the carbonaceous particles having the volume resistivity of particle mass of not more than 0.05 ohm·cm with a compression force of from about 640 to about 960 kgf/cm$^2$ applied thereto.

In accordance with a feature of the invention, there is provided in a PTC device, a PTC element comprised of a crystalline polymer mass having essentially unstructured conductive carbonaceous particles substantially uniformly dispersed therethrough, the conductive carbon black particles being separable one from another upon thermal expansion of the polymer, the carbonaceous particles having the volume resistivity of particle mass of not more than 0.05 ohm·cm with a compression force of from about 640 to about 960 kgf/cm$^2$ applied thereto, the conductive carbon black being pretreated by heating it in an inactive atmosphere, with the crystalline polymer being grafted onto the conductive carbonaceous particles by thermally blending the conductive carbonaceous particles with the crystalline polymer in the presence of an organic peroxide.

In accordance with a further feature of the invention, there is provided a method for making a PTC element, the steps of thermally treating conductive carbon black particles in an inactive atmosphere, blending the carbon black with a crystalline polymer in a roll mill at constant temperature to form a blended mixture with the blending of the carbon black particles and crystalline polymer being effected in amounts of each such as to produce a blended mixture having the volume resistivity of not more than 0.05 ohm·cm under a compression force of from about 640 to about 960 kgf/cm$^2$, cooling the mixture and forming it into chips, sandwiching the chips between conductive plates, molding the chip/-conductive plate sandwiches into a PTC element in a compression mold by application of heat and pressure thereto, and then annealing the element.

The invention provides that thermal black is used as the conductive particles to be blended with crystalline polymer to comprise a PTC element. "Thermal black" it will be understood means carbon black that is obtained by thermal decomposition of natural gas in a thermal furnace.

Conductive carbon black, such as. for example, Ketjen black EC is capable of giving polymer conductivity by being dispersed in polymer. This Ketjen black has a characteristically small particle diameter, a large specific surface area and a firm structure. It is generally believed that thermal black, which has large particle size, small specific surface area and almost no structure, is not suitable for dispersal in polymer to make the polymer conductive.

However, if the volume resistivity of the thermal black particle mass under 800 kgf/cm$^2$ of pressure is not more than 0.05 ohm·cm, it is possible to produce a PTC element having excellent PTC characteristics and volume resistivity equivalent to or lower than those using conventional conductive carbon black.

Thermal black has a large particle size and small specific surface area, and is easily dispersed in polymer. Evenly dispersed particles can be effectively separated from each other by thermal expansion of the polymer to exhibit excellent PTC characteristics.

As thermal black has almost no structure, polymer does not enter into its structure and, because of its small specific surface area, the entire surface of a thermal black particle is covered by a small amount of polymer. Therefore, more conductive particles of thermal black can be blended into the polymer as when conductive carbon black is used. The higher the percentage of conductive particles to polymer, the lower the volume resistivity of a PTC element. A resulting advantage of using thermal black for reducing volume resistivity of a PTC element is that it allows an increased blending ratio. For example, it is difficult to blend 100 gm of Ketjen black EC, one of the most commonly used conductive carbon blacks, with 100 gm of high density polyethylene. However, as much as 300 gm of thermal black can be blended with 100 gm of high density polyethylene.

As described above, superior PTC characteristics result from the structural characteristics of thermal black, these are large particle size, small specific surface area, lack of structure, and low volume resistivity of particle aggregation. Thus, it is possible to make a PTC element having both a low volume resistivity and superior PTC characteristics by using carbonaceous particles produced by a method different from that of thermal black, as long as their low volume resistivity and structural characteristics are similar to that of thermal black. One such material is mesocarbon microbead. Mesocarbon microbeads are microscopic spherical carbonaceous particles produced by heating and liquid-phase extracting of pitch. The particle shape of mesocarbon microbeads is similar to that of thermal black. Therefore, a PTC element with superior PTC characteristics can be made by using mesocarbon microbeads having the volume resistivity of particle mass that is not more than 0.05 ohm·cm under 800 kgf/cm$^2$ of pressure.

A second embodiment of a PTC element of the present invention may use thermal black or mesocarbon microbeads the volume resistivity of particle mass of which is more than 0.05 ohm·cm under 800 kgf/cm$^2$ of pressure, because its volume resistivity can be reduced by thermal treatment in an inactive gaseous atmosphere to improve the PTC characteristics of the element when blended in polymer.

Another embodiment of a PTC element of the present invention uses thermal black or mesocarbon microbeads whose volume resistivity of particle mass is originally not more than 0.05 ohm·cm under 800 kgf/cm$^2$ of pressure and is further reduced by thermal treatment in an inactive gaseous atmosphere. Thus treated conductive particles result in further improved PTC characteristics when blended in polymer.

Another PTC element of the present invention uses peroxide. When peroxide is added to a mixture of crystalline polymer and conductive particles during the process of thermal blending free, radicals generated during decomposition of the peroxide extract hydrogen atom from the polymer and produce polymer having unpaired electrons that cause grafting of the polymer radicals onto the surface of conductive particles. As a result, change of resistance value after current limiting action of a polymer-type PTC element used as an overcurrent protection element is restrained.

The above, and other objects, features and advantages of the present invention will become apparent from the following description read in conjunction with the accompanying drawings, in which like reference numerals designate the same elements.

DETAILED DESCRIPTION OF PREFERRED EMBODIMENTS

Figure 1:
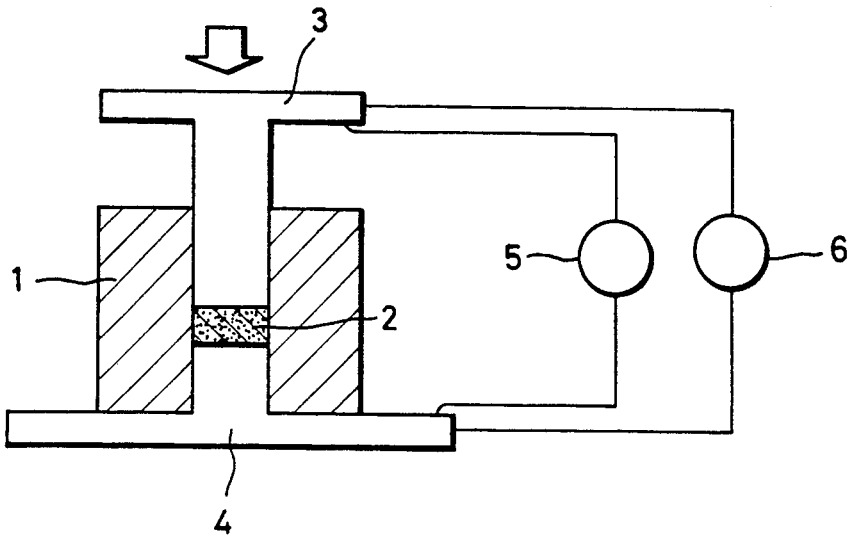
FIG. 1 depicts a measuring device for measuring the volume resistivity of a conductive particle mass.

First, a method for measuring a volume resistivity of a conductive particle mass will be explained. Referring to FIG. 1, a BAKELITE cylinder 1 having an inner diameter of 10 mm is positioned over a lower piston 4. A sample 2 consisting of 0.5 gm of a particle mass of carbon black is placed in cylinder 1 to be compressed between lower piston 4 and an upper piston 3, which is slidably inserted into a top opening of cylinder 1. Pistons 3 and 4, which compress sample 2 with 800 kgf/cm$^2$ of pressure applied by a press (not shown), also serve as electrodes. A digital multimeter 5 and a 10 mA DC power source 6 are each connected between pistons 3 and 4.

Using this four-terminal method, a voltage decrease is registered by digital multimeter 5 as pressure is applied. This indicates that the resistance value R (ohms) of sample 2 decreases as it is compressed. The current for measurement is 10 mA. The thickness, t(cm) of sample 2 is also monitored as pressure is applied to determine the relationship of thickness to the measured voltage decrease. Volume resistivity, $\rho_{particle}$ (ohm·cm), of the particle mass is calculated from measurement results and the inside circular area S of cylinder 1, in accordance with the following formula.

$$\rho_{particle} = R \cdot s / t$$

Figure 2:
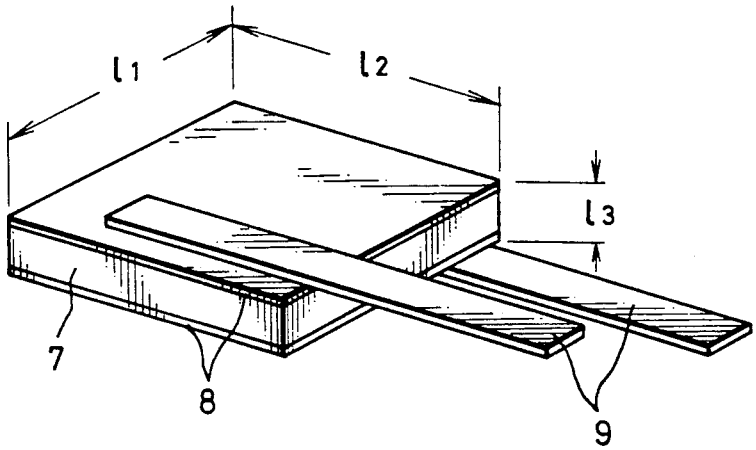
FIG. 2 is a perspective view of a PTC device embodying a PTC element made in accordance with the present invention.

Referring to FIG. 2, a PTC element 10 is comprised of a body 7 of crystalline polymer containing conductive carbon black dispersed substantially uniformly therethrough, the body being sandwiched between electrodes 8. Terminals 9 are fixed to each electrode 8 for connecting the element for use thereof.

In a first form of the invention, high density polyethylene (Hi-Zex 1300J, manufactured by Mitsui Petrochemical Industries) was used as the crystalline polymer while the conductive particles used in embodiments 1-1 and 1-2 of the invention and in comparison examples 1 through 4 were as listed in Table 1.

In making the body 7 for each embodiment and comparison example product, the following procedure was observed. For each, the polymer and the conductive particles were blended on a roll mill at a fixed temperature of about 135 degrees C. Several mixtures were made, each having a different ratio of types of conductive particle. Molding material was made from each mixture by cooling and then crushing the mixture into approximately 2 mm chips. Molding material chips (PTC element precursors) were sandwiched between a pair of rough-surfaced 25$\mu$ thick electrolytic nickel foil electrodes 8 (manufactured by Fukuda Metal Foil & Powder Co., Ltd.) and pressmolded in a metal mold at molding conditions of 200 degrees C. temperature and molding pressure of 465 kgf/cm$^2$ maintained for a specified time.

The molded material was cooled to below 50 degrees C. under a pressure of 116 kgf/cm$^2$ and then removed from the metal mold. The thickness of each embodiment and comparison product was controlled at about 1 mm by adjusting the amount of the molding material used and the duration of molding. Each product then was annealed by heating in a constant-temperature oven at 100 degrees C. for 2 hours to regulate deformation and then cross-linking was affected by exposure to a radiation of 10 Mrad of gamma radiation. After cross-linking, each embodiment and comparison product was completed by attaching terminals 9 to electrodes 8.

As shown in FIG. 2, the surface dimensions l1 and l2 of the element 10 respectively are 13 mm and thickness l3 is 1 mm.

The resistance and temperature of each product were measured, and based on relationship of resistance to temperature, the height of positive thermal coefficient (PTC) of each was calculated. The resistance-temperature characteristics were measured by placing each product in a constant-temperature oven and measuring its resistance at each degree of temperature rise as the oven temperature was increased from 20 to 150 degrees C. at the rate of approximately 1 degree C./min. The resistance value in ohms of a sample at 20 degrees C. ($R_{20}$) and the maximum resistance value in ohms in the range from 20 degrees C. to 150 degrees C. (Rmax) were found from the thus measured resistance/temperature characteristics. The height of PTC was then calculated using the following formula.

$$\text{height of PTC} = \log_{10}(R_{max}/R_{20})$$

The results of the calculations are given in Table 2. The change of volume resistivity of PTC element 7 in relation to the percentage of conductive particles is shown in FIG. 3, whereas the change of the peak PTC in relation to the change of volume resistivity is shown in FIG. 4.

Figure 3:
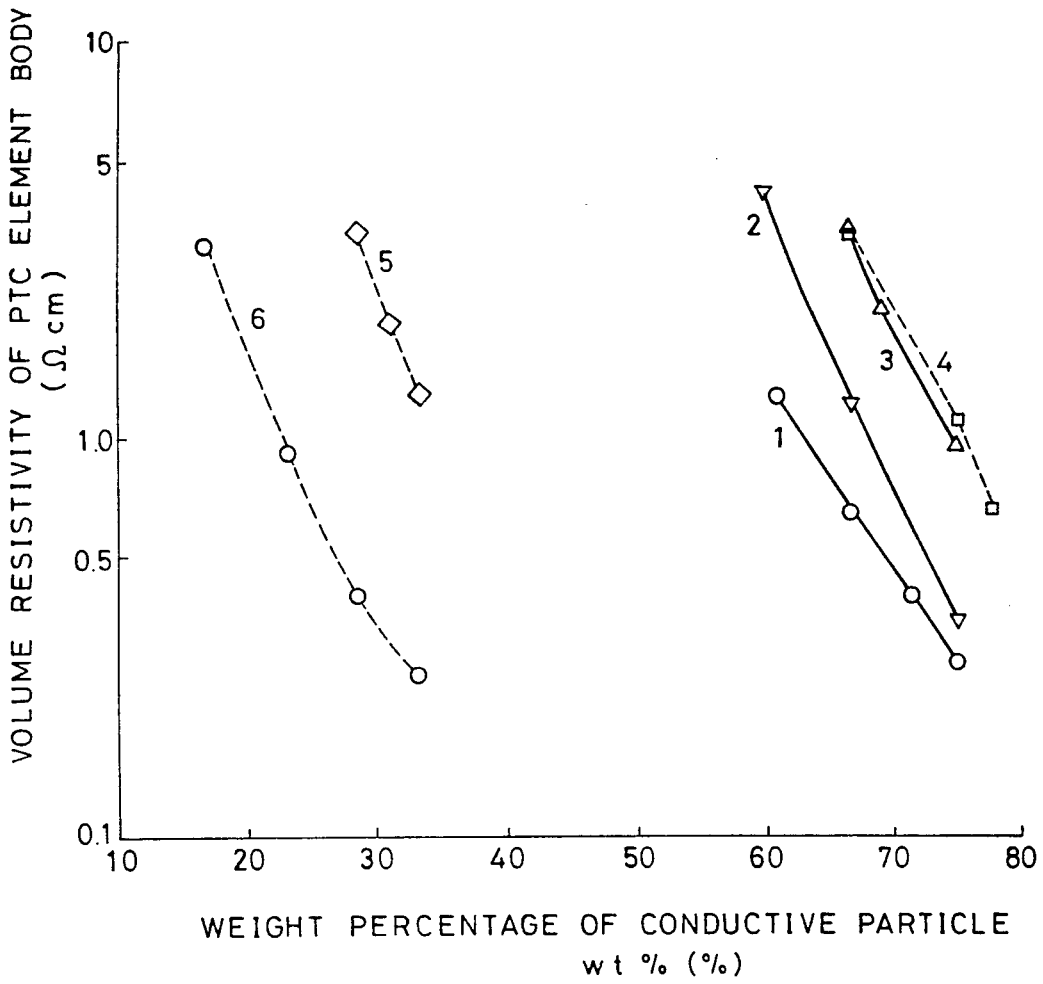
FIG. 3 is a graph showing volume resistivity of the FIG. 2 PTC element in relation to the ratio of amount of conductive particles thereof.
Figure 4:
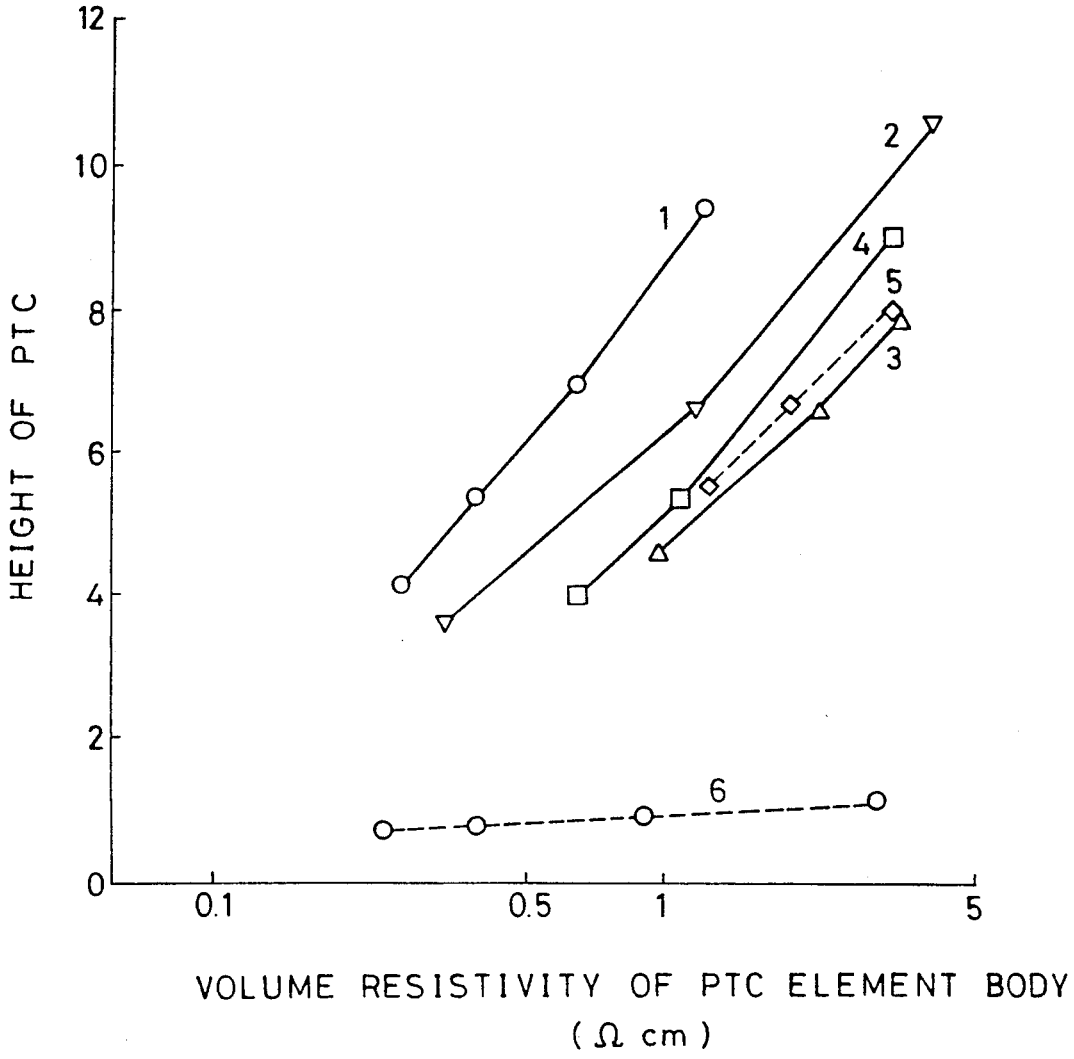
FIG. 4 is a graph showing height of PTC of the FIG. 2 PTC element in relation to its volume resistivity.

Referring to FIG. 3, embodiment 1-1 (SEVACARB MT) is reference numeral 1. Embodiment 1-2 (MESOCARBON MICROBEADS) is reference numeral 2.

Comparison example 1 (THERMAX N-990 ULTRA-PURE) is reference numeral 3. Comparison example 2 (THERMAX N-990 FLOFORM) is reference numeral 4. Comparison example 3 (ASAHI #60H) is reference numeral 5. Comparison example 4 (KETJEN BLACK EC) is reference numeral 6. In FIG. 3, it can be seen that the volume resistivities of embodiments 1-1 and 1-2 are lower than those of comparison examples 1 and 2 with the same amount of thermal black used. The shapes and other exterior conditions of particles of the thermal black of the comparison examples and embodiments 1-1 and 1-2 were similar.

With comparison examples 3 and 4, in which conductive particles having different exterior characteristics, if the weight percentage of conductive particles in the mixture is small, similar volume resistivity values are obtained. However, due to large specific surface area and well-developed structure of particles used in comparison examples 3 and 4 it is difficult to increase the blending percentage of conductive particles to the levels possible with embodiments 1-1 or 1-2. In fact, increasing the percentage of conductive particles to more than 33.3% by weight was extremely difficult during testing of comparision example 4 using the blending methods of the experiment. The 33.3% by weight blend of comparison example 4 is very fragile, demonstrating the difficulty of increasing its blending ratio. The foregoing establishes that use of the conductive particles of embodiments 1-1 and 1-2 produce a PTC element having low resistivity, similar to a PTC element using conductive carbon black.

With reference now to FIG. 4, embodiment 1-1 is reference numeral 1. Embodiment 1-2 is reference numeral 2. Comparison example 1 is reference numeral 3. Comparison example 2 is reference numeral 4. Comparison example 3 is reference numeral 5. Comparison example 4 is reference numeral 6. In FIG. 4, it can be seen that the height of PTC values of embodiments 1-1 and 1-2 in relation to their respective volume resistivity are higher than those of Comparison Examples 1 through 4.

In another embodiment of the invention, the conductive particles listed in Table 1 (for example, Sevacarb MT, Thermax N-990 Ultrapure, Thermax N-990 Floform and Asahi #60H) were heat treated in a nitrogen atmosphere. The heat treatment requires placing conductive particles in a flat bottomed porcelain dish in an electric furnace and increasing the temperature of the furnace after replacing the atmosphere in the furnace with nitrogen gas, maintaining the temperature at a specified level and then cooling the conductive particles to room temperature. Throughout this process, nitrogen constantly flows into the furnace at a flow rate of 1 liter/min.

Table 3 gives the conditions of the heat treatment and volume resistivity after treatment of a mass of each type of conductive particle under 800 kgf/cm$^2$ of pressure. Products were made as previously described for the first embodiment, using conductive particles listed in Table 3. The respective height of PTC of each PTC element of the products of this second embodiment was also calculated. The results of these calculations are given in Table 4.

Figure 5:
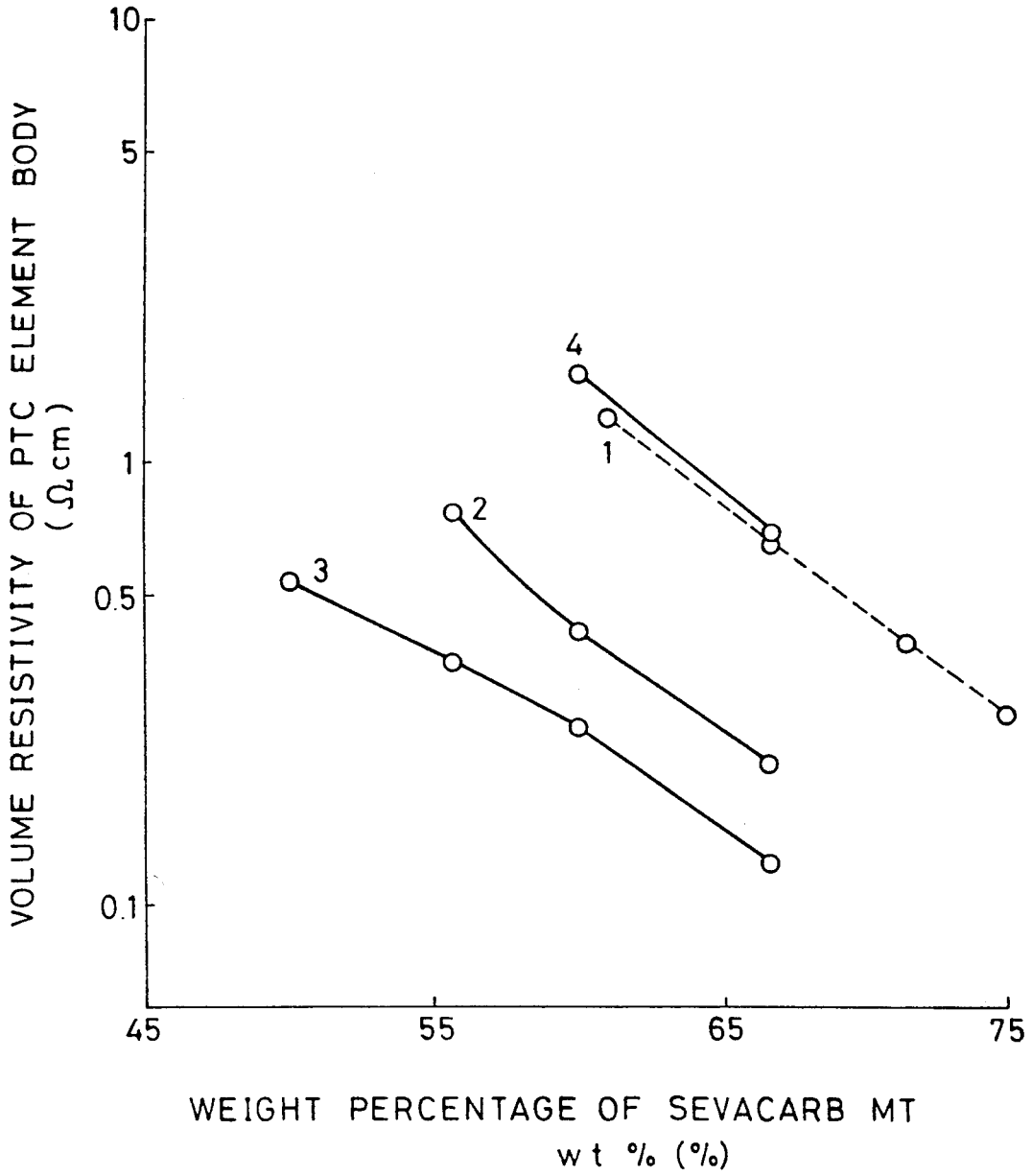
FIG. 5 is a graph showing volume resistivity of a FIG. 2 PTC element in relation to the ratio of a Sevacarb MT component embodied therein and which has been subjected to heat treatment.

FIG. 5 shows changes of volume resistivity of the PTC element relative to blend percentage of Sevacarb MT conductive particles which have been heat treated in a nitrogen atmosphere.

In FIG. 5, the PTC before treatment is reference numeral 1. Embodiment 2-1 is reference numeral 2. Embodiment 2-2 is reference numeral 3. Comparison example 5 is reference numeral 4.

Figure 6:
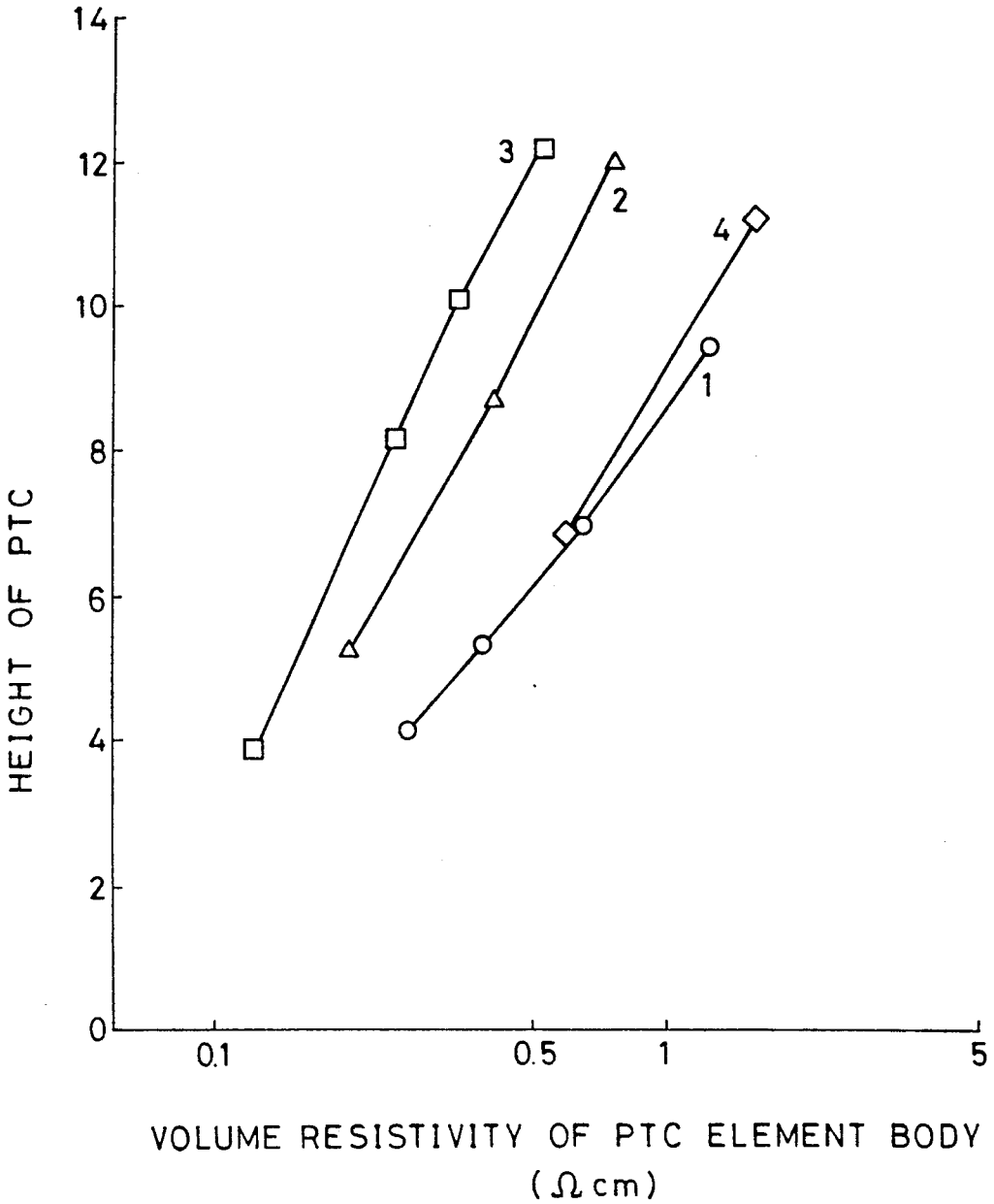
FIG. 6 is a graph showing height of PTC of the PTC element referred to in FIG. 5 in relation to its volume resistivity.

FIG. 6 shows changes of respective height of the PTC element in relation to changes of volume resistivity.

In FIG. 6, the PTC before treatment is reference numeral 1. Embodiment 2-1 is reference numeral 2. Embodiment 2-2 is reference numeral 3. Comparison example 5 is reference numeral 4.

Figure 7:
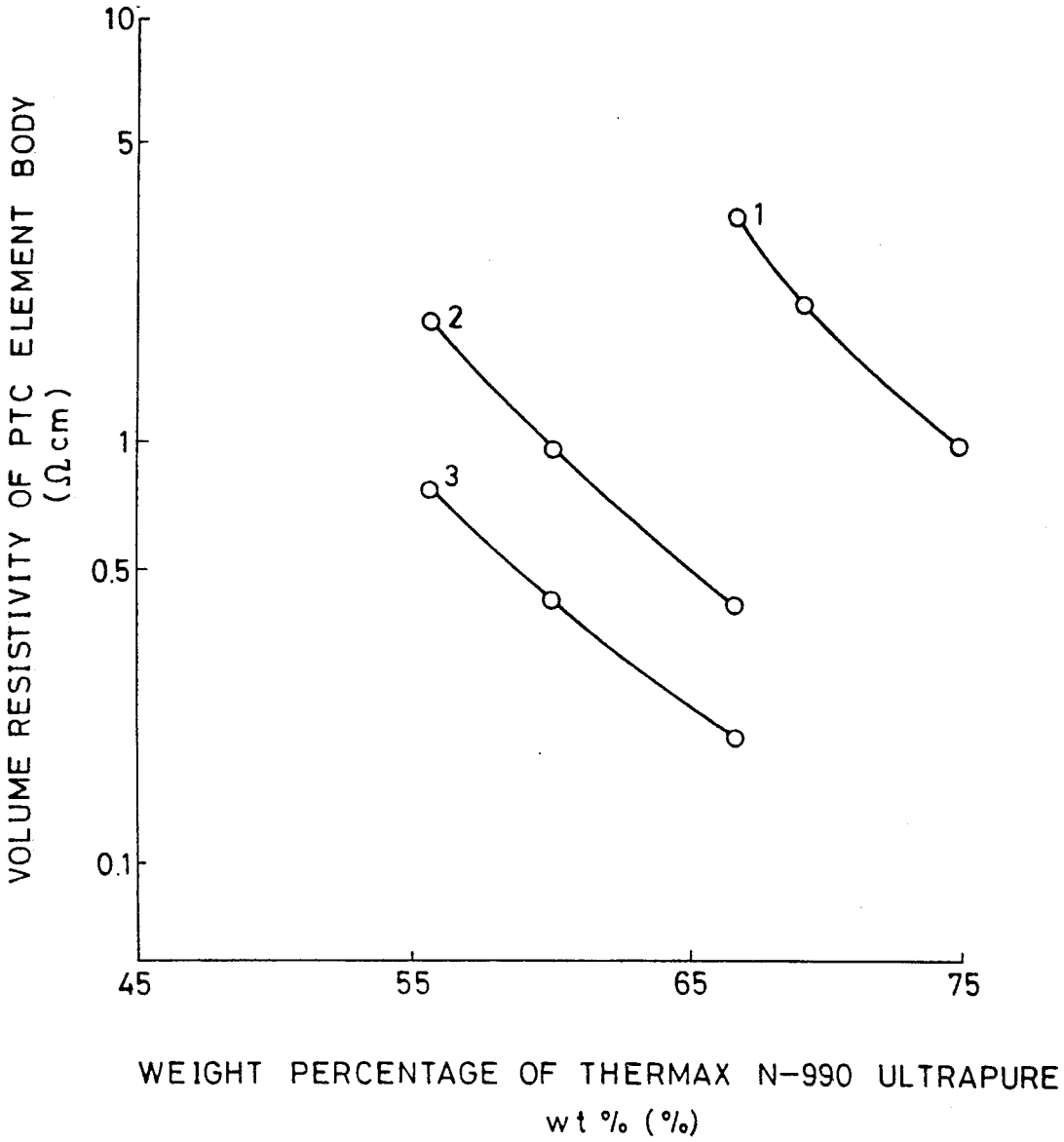
FIG. 7 is a graph showing volume resistivity of a PTC element in relation to the weight percentage of a Thermax N-990 Ultra-Pure component used in the element, the carbon component being subjected to heat treatment.

FIG. 7 shows changes of volume resistivity of PTC element relative to blending percentages of the conductive particles heat treated Thermax N-990 Ultrapure.

Figure 8:
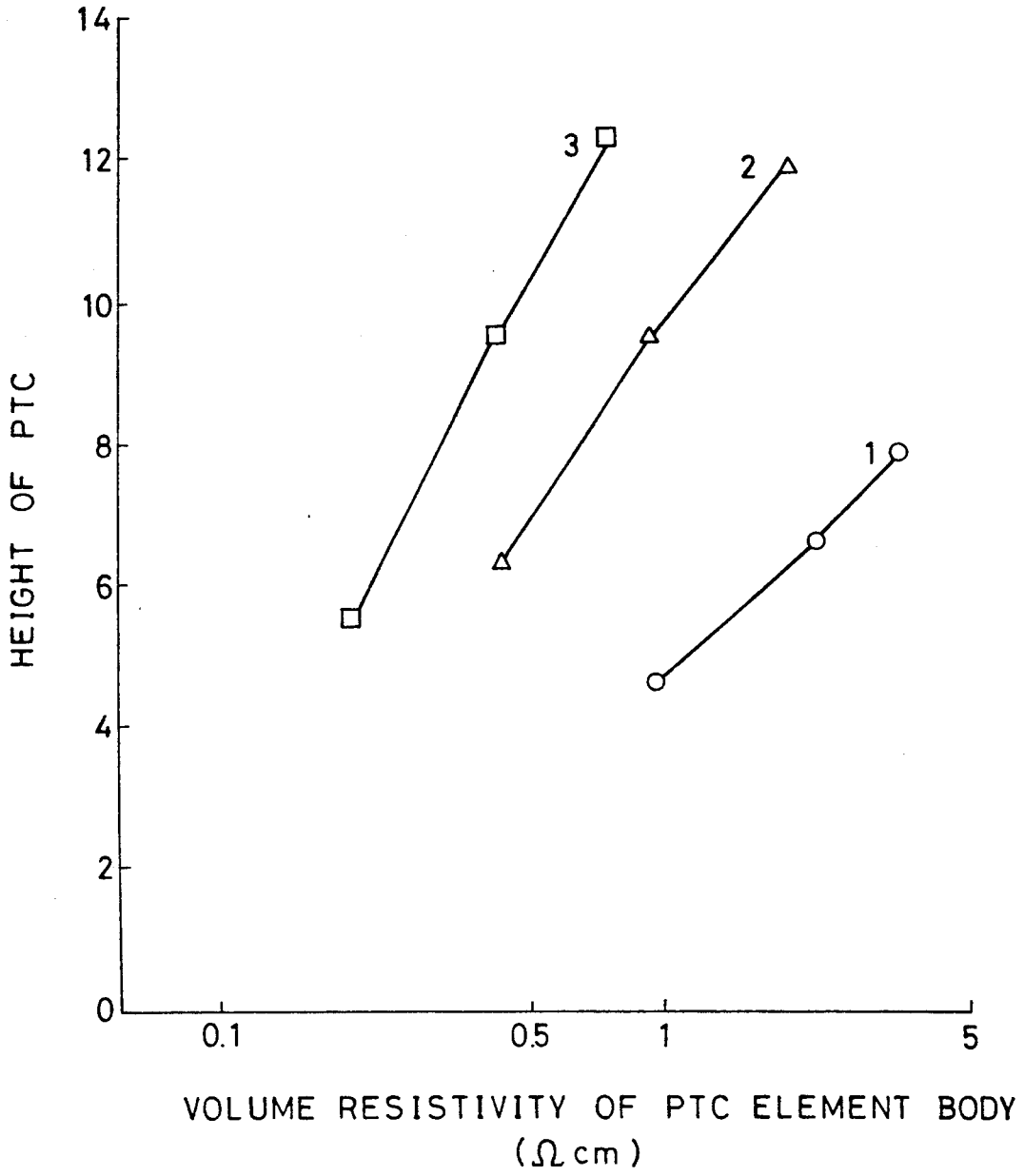
FIG. 8 is a graph showing height of PTC of a Thermax N-990 Ultra-pure carbon black used in the element in relation to changes in its volume resistivity.

In FIG. 7, the PTC before treatment is reference numeral 1. Embodiment 2-3 is reference numeral 2. Embodiment 2-4 is reference numeral 3. FIG. 8 shows changes of the height of PTC in relation to changes of volume resistivity.

In FIG. 8, the PTC before treatment is reference numeral 1. Embodiment 2-3 is reference numeral 2. Embodiment 2-4 is reference numeral 3.

Figure 9:
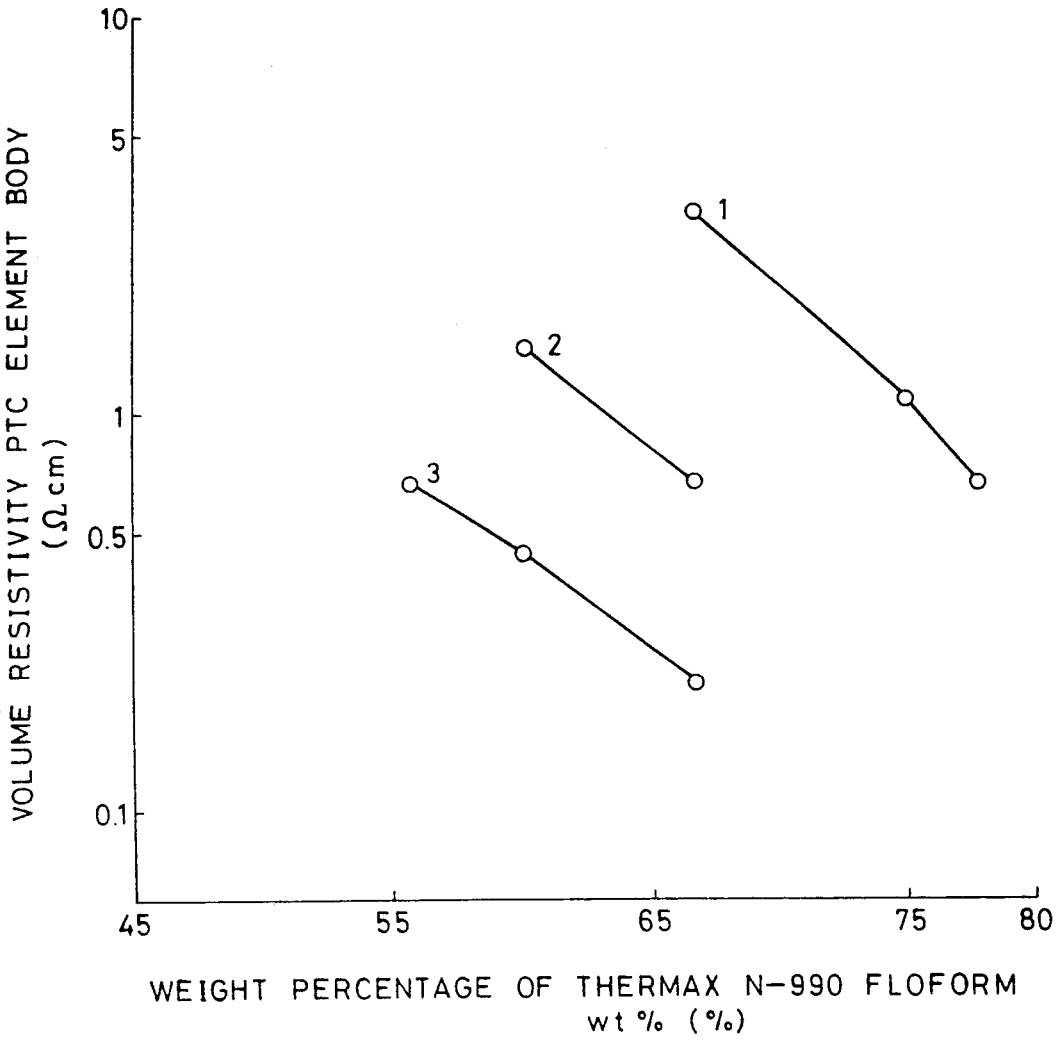
FIG. 9 is a graph showing volume resistivity of a PTC element in relation to the amount of a Thermax N-990 Floform carbon used therein, the carbon black having been heat treated.

FIG. 9 illustrates how the volume resistivity of the PTC element changes depending on the blending percentages where Thermax N-990 conductive particles are used, these particles being heat treated in a nitrogen atmosphere.

Figure 10:
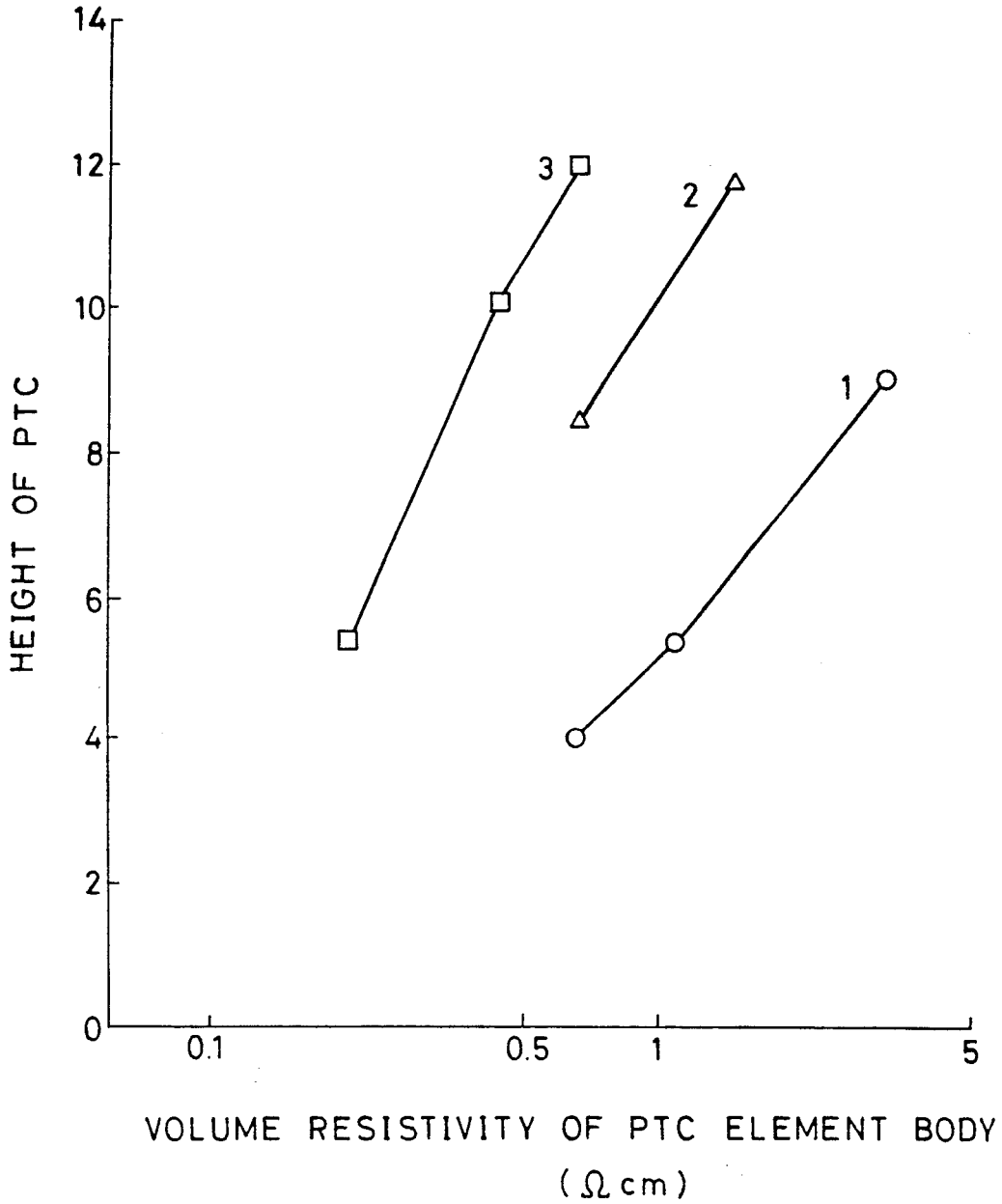
FIG. 10 is a graph showing height of PTC of the FIG. 9 described PTC element in relation to its volume resistivity.

In FIG. 9, the PTC before treatment is reference numeral 1. Embodiment 2-5 is reference numeral 2. Embodiment 2-6 is reference numeral 2-6. FIG. 10 shows changes of respective height of PTC of the Thermax N-990 element in relation to changes of volume resistivity.

In FIG. 10, the PTC before treatment is reference numeral 1. Embodiment 2-5 is reference numeral 2. Embodiment 2-6 is reference numeral 3.

Figure 11:
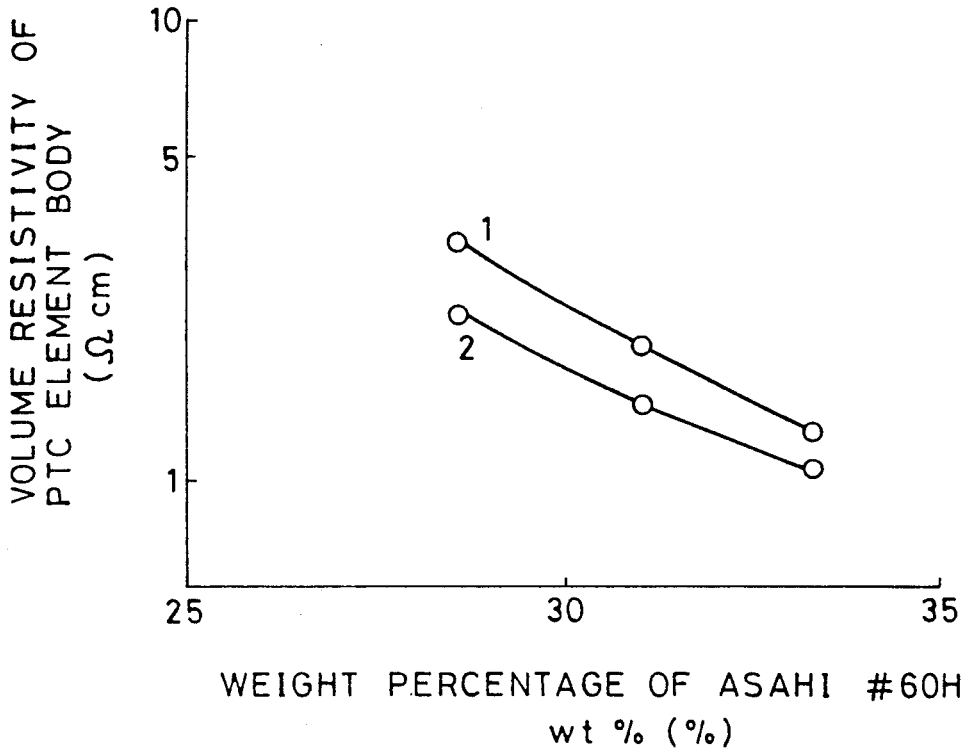
FIG. 11 is a graph showing volume resistivity of a PTC element in relation to the ratio of Asahi #60 H component used therein and which is heat treated.
Figure 12:
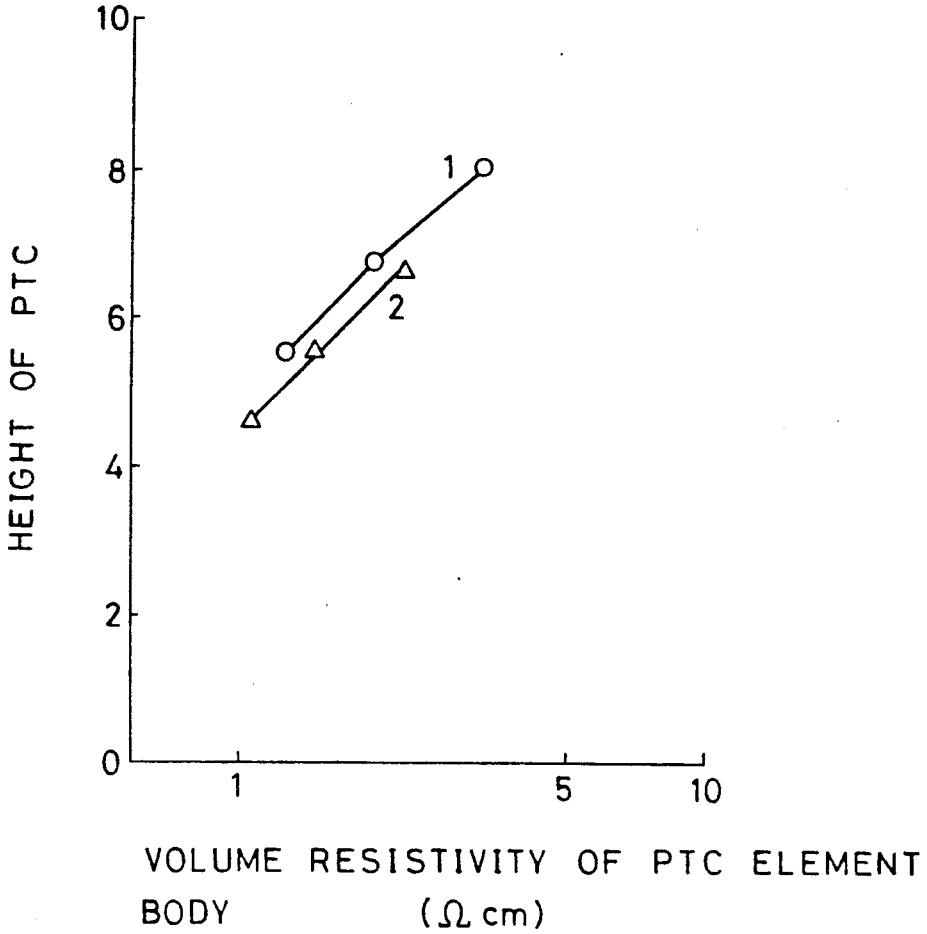
FIG. 12 is a graph showing height of PTC element mentioned in FIG. 11 in relation to its volume resistivity.

FIG. 11 shows changes of volume resistivity of the PTC element relative to blending percentages where heat treated Asahi #60H (furnace black) conductive particles are used. In FIG. 11, the PTC before treatment is reference numeral 1 and comparison example 6 is reference numeral 2 and FIG. 12 shows changes of respective height of PTC of the PTC element in relation to changes of volume resistivity. In FIG. 12, the PTC before treatment is reference numeral 1 and comparison example 6 is reference numeral 2.

The above data indicates that the volume resistivity of a PTC element 7 using thermal black with a high particle mass volume resistivity can be reduced and its height of PTC greatly increased relative to its volume resistivity by subjecting it to heat treatment in a nitrogen atomosphere and reducing it to less than 0.05 ohm·cm under 800 kgf/cm$^2$ of pressure. By making the heat treatment more intensive, the rate of decrease of volume resistivity of PTC element 7 and the rate of increase of its height of PTC can be made even greater, as given in Table 4 for embodiments 2-3, 2-4, 2-5 and 2-6.

The volume resistivity of a PTC element 7 using thermal black, which already has superior PTC characteristics because of low particle mass volume resistivity, can be further reduced, and its PTC characteristics further improved, in the same manner (Table 4 embodiments 2-1 and 2-2).

It is seen that heat treatment will not cause decreased volume resistivity of a PTC element 7 nor improve its PTC characteristics if the volume resistivity of its conductive particle mass is not reduced by heat treatment (comparison example 5).

With furnace black, although volume resistivity of conductive particle mass and a PTC element 7 using furnace black were reduced by heat treatment, the peak PTC of such PTC element relative to its volume resistivity decreased somewhat (comparison example 6).

Third product embodiments were prepared to determine the stability of resistance value of a PTC element made of Sevacarb MT, one of the conductive particles listed in Table 1, grafted with crystalline polymer following a current limiting operation. Grafting is accomplished by adding organic peroxide during the thermal blending process.

High density polyethylene (Hi-Zex 3000B manufactured by Mitsui Petro-Chemical Industries) was used as the crystalline polymer. Sixty grams of Hi-Zex 3000B and 111 gm of Sevacarb MT were blended together and heated, using a roll mill whose surface temperature was set at 160 degrees C. Six tenths of a gram of peroxide, such as Perhexyne 25B-40(manufactured by Nippon Oil Fat Co.) was added 5 minutes after the blending of Sevacarb MT for five minutes in the high density polyethylene. The thermal blending process was continued for an additional 30 minutes to allow for the grafting reaction to take place. Products were then produced from the mixture in the same manner as for the first embodiment, except that 60 Mrads instead of 10 Mrads of gamma radiation was used. A comparison product was made from a mixture of 100 gm of Hi-Zex 3000B and 150 gm of Sevacarb MT in the same manner, without adding organic peroxide. The product containing organic peroxide exhibited a resistance value of 0.118 ohms and volume resistivity of 2.0 ohm·cm, whereas resistance value and volume resistivity of the comparison product registered 0.122 ohms and 2.2 ohm·cm respectively.

Products of the third embodiment and the comparison product were obtained by electrically aging each, this being affected by connecting each of them to a circuit consisting of serially arranged 2 ohm resistors and applying 18 volts DC to the circuit for 15 minutes. Resistance values of the embodiment product and the comparison product were 0.200 ohms and 0.208 ohms, respectively.

The above voltage application for electrical aging was repeated 580 times to each of the products to compare changes in resistance values. Each aging cycle consisted of voltage application for 15 minutes followed by a 15 minute pause, these cycles being repeated without interruption.

The result is given in Table 5, in which the products are represented as embodiment 3 and comparison example 7.

Table 5 shows that the grafting method stabilizes the resistance value following a current limiting operation of the PTC element, because embodiment 3 showed less change of resistance value than comparison example 7, which was not given grafting treatment. Other dialkylperoxides, such as, for example, dicumylperoxide, may be used as organic peroxide for this purpose.

Because the conductive particles to be dispersed in crystalline polymer are either thermal black or mesocarbon microbeads having large particle size, small specific surface area and almost no structure, and whose particle mass volume resistivity under 800 kgf/cm$^2$ of pressure is not more than 0.05 ohm·cm, it is possible to produce a PTC characteristics element having lower volume resistivity and higher PTC by blending these conductive particles with the crystalline polymer.

The volume resistivity of a conductive particles mass can be further reduced by heat treatment, e.g., from more than 0.05 ohm·cm to less than 0.05 ohm·cm A conductive particle mass whose volume resistivity is less than 0.05 ohm·cm also can be reduced to an even lower value by heat treatment. In addition, the PTC characteristics of a PTC element using these particles are improved further.

Where a PTC element is used as an overcurrent protection element, its resistance value can be stablized following current limiting operations by grafting to the crystalline polymer onto the conductive particles at the time of dispersion, the conductive particle being so grafted by adding organic peroxide and blending and heating the mixture at the same time.

Having described preferred embodiments of the invention with reference to the accompanying drawings, it is to be understood that the invention is not limited to those precise embodiments, and that various changes and modifications may be effected therein by one of ordinary skill in the art without departing from the scope or spirit of the invention as defined in the appended claims.

TABLE 1

| No. | Name of Product | Maker | Type | Particle Diameter (nm) | Specific Surface Area (m$^2$/g) | DBP absorption (ml/100 g) | pH* | Volume Resistivity Under 800 kgf/d (Ωcm) |
|---|---|---|---|---|---|---|---|---|
| Embodiment 1-1 | Sevacarb MT | Columbian Carbon Japan Ltd. | Thermal Black | 350 | 6 | 41 ± 5 | 8.6 | 0.031 |
| Embodiment 1-2 | Graphitized Mesocarbon Microbeads MPA-17-3 | Kansai Tar Industries Co. | Mesocarbon Microbeads | 6000 | — | — | 9.9 | 0.011 |
| Comparison Example 1 | ThermaxN-990 Ultrapure | Cancarb Limited | Thermal Black | 270 | 9 | 34~40 | 5.9 | 0.070 |
| Comparison Example 2 | ThermaxN-990 Floform | Cancarb Limited | Thermal Black | 270 | 9 | 34~40 | 9.6 | 0.065 |
| Comparison Example 3 | Asahi#60H | Asahi Carbon Co., Ltd. | Frunace Black for Rubber | 41 | 45 | 124 | 6.4 | 0.031 |
| Comparison Example 4 | Ketjen Black EC | Nippon EC Co., Ltd. | Conductive carbon Black | 30 | 950 | 350 | 9.2 | 0.024 |

*Ref. JIS K6221

TABLE 2

| No. | Conductive Particle Name of Product (TYPE) Volume Resistivity Under 800 kgf/cf [Ωcm] | PTC Composition Weight* Ratio [%] | Volume Resistivity [Ωcm] | Height of PTC |
|---|---|---|---|---|
| Embodiment 1-1 | Sevacarb MT (Thermal Black) 0.031 | 75.0 | 0.266 | 4.12 |
| | | 71.4 | 0.390 | 5.34 |
| | | 66.7 | 0.646 | 6.99 |
| | | 61.0 | 1.26 | 9.46 |
| Embodiment 1-2 | Graphitized Mesocarbon Microbeads MPA-17-3 (Mesocarbon Microbeads) 0.011 | 75.0 | 0.338 | 3.56 |
| | | 66.7 | 1.19 | 6.60 |
| | | 60.0 | 4.07 | 10.6 |
| Comparison Example 1 | Thermax N-990 Ultrapure (Thermal Black) 0.070 | 75.0 | 0.975 | 4.65 |
| | | 69.2 | 2.14 | 6.61 |
| | | 66.7 | 3.42 | 7.92 |
| Comparison Example 2 | Thermax N-990 Floform (Thermal Black) 0.065 | 77.8 | 0.661 | 4.03 |
| | | 75.0 | 1.10 | 5.36 |
| | | 66.7 | 3.33 | 9.05 |
| Comparison Example 3 | Asahi #60H (Furnace Black for Rubber) 0.031 | 33.3 | 1.28 | 5.54 |
| | | 31.0 | 1.93 | 6.72 |
| | | 28.6 | 3.33 | 8.07 |
| Com- | Ketjen Black EC | 33.3 | 0.244 | 0.710 |

TABLE 2-continued

| No. | Conductive Particle Name of Product (TYPE) Volume Resistivity Under 800 kgf/cf [Ωcm] | PTC Composition Weight* Ratio [%] | Volume Resistivity [Ωcm] | Height of PTC |
|---|---|---|---|---|
| parison Example 4 | (Conductive Carbon Black) 0.024 | 28.6 | 0.394 | 0.785 |
| | | 23.1 | 0.920 | 0.909 |
| | | 16.7 | 3.04 | 1.11 |

$$\text{*Weight Ratio [\%]} = \frac{\text{Conductive Particle Weight}}{\text{Conductive Particle Weight} + \text{Hi-zex1300J Weight}} \times 100$$

TABLE 3

| No. | Name of Carbon Black being used in treatment | Condition of Treatment | Volume Resistivity After Treatment (Ωcm) | Decrease of Volume Resistivity |
|---|---|---|---|---|
| Embodiment 2-1 | Sevacarb MT | 1000° C. 4 Hours | 0.023 | Yes |
| Embodiment 2-2 | Sevacarb MT | 1000° C. 18 Hours | 0.018 | Yes |
| Embodiment 2-3 | Thermax N-990 Ultrapure | 1000° C. 4 Hours | 0.026 | Yes |
| Embodiment 2-4 | Thermax N-990 Ultrapure | 1000° C. 18 Hours | 0.020 | Yes |
| Embodiment 2-5 | Thermax N-990 Floform | 1000° C. 4 Hours | 0.029 | Yes |
| Embodiment 2-6 | Thermax N-990 Floform | 1000° C. 18 Hours | 0.019 | Yes |
| Comparison Example 5 | Sevacarb MT | 500° C. 2 Hours | 0.030 | Almost Nil |
| Comparison Example 6 | Asahi #60H | 1000° C. 6 Hours | 0.028 | Yes |

TABLE 4

| No. | Conductive Particle: Name of Product (TYPE) and Volume Resistivity Under 800 kgf/d(Ωcm) | Condition of Treatment and Volume Resistivity After Treatment (Ωcm) | PTC Composition Weight* Ratio (%) | Volume Resistivity (Ωcm) | Height of PTC |
|---|---|---|---|---|---|
| Embodiment 2-1 | Sevacarb MT (Thermal Black) 0.031 | 1000° C. 4 Hours 0.023 | 66.7 | 0.201 | 5.33 |
| | | | 60.0 | 0.411 | 8.73 |
| | | | 55.6 | 0.765 | 12.1 |
| Embodiment 2-2 | Sevacarb MT (Thermal Black) 0.031 | 1000° C. 18 Hours 0.018 | 66.7 | 0.122 | 3.82 |
| | | | 60.0 | 0.250 | 8.18 |
| | | | 55.6 | 0.343 | 10.1 |
| | | | 50.0 | 0.533 | 12.2 |
| Embodiment 2-3 | Thermax N-990 Ultrapure (Thermal Black) 0.070 | 1000° C. 4 Hours 0.026 | 66.7 | 0.416 | 6.31 |
| | | | 60.0 | 0.952 | 9.56 |
| | | | 55.6 | 1.95 | 11.9 |
| Embodiment 2-4 | Thermax N-990 Ultrapure (Thermal Black) 0.070 | 1000° C. 18 Hours 0.020 | 66.7 | 0.200 | 5.50 |
| | | | 60.0 | 0.421 | 9.58 |
| | | | 55.6 | 0.761 | 12.3 |
| Embodiment 2-5 | Thermax N-990 Floform (Thermal Black) 0.065 | 1000° C. 4 Hours 0.029 | 66.7 | 0.669 | 8.48 |
| | | | 60.0 | 1.48 | 11.8 |
| Embodiment 2-6 | Thermax N-990 Floform (Thermal Black) 0.065 | 1000° C. 18 Hours 0.019 | 66.7 | 0.207 | 5.34 |
| | | | 60.0 | 0.441 | 10.1 |
| | | | 55.6 | 0.666 | 12.0 |
| Comparison Example 5 | Sevacarb MT (Thermal Black) 0.031 | 500° C. 2 Hours 0.030 | 66.7 | 0.699 | 6.84 |
| | | | 60.0 | 1.59 | 11.3 |
| Comparison Example 6 | Asahi #60H (Furnace Black for Rubber) 0.031 | 1000° C. 6 Hours 0.028 | 33.3 | 1.05 | 4.66 |
| | | | 31.0 | 1.47 | 5.60 |
| | | | 28.6 | 2.27 | 6.63 |

TABLE 5

| No. | Organic Peroxide was Added | Initial Resistance Value [Ω] | Resistance value After 580 Cycles of Voltage Application [Ω] | Change in Resistance* [%] |
|---|---|---|---|---|
| Embodiment 3 | Yes | 0.200 | 0.225 | +12.5 |
| Comparison Example | No | 0.208 | 0.360 | +73.1 |

TABLE 5-continued

| No. | Organic Peroxide was Added | Initial Resistance Value [Ω] | Resistance value After 580 Cycles of Voltage Application [Ω] | Change in Resistance* [%] |
|---|---|---|---|---|
| 7 | | | | |

$$\text{*Change in Resistance [\%]} = \frac{\text{Resistance value After 580 Cycles of Voltage Application} - \text{Initial Resistance Value}}{\text{Initial Resistance Value}} \times 100$$

What is claimed is:

1. In a PTC device, a PTC element comprised of a crystalline polymer mass having essentially unstructured conductive carbonaceous particles dispersed therethrough the conductive carbonaceous particles being separable one from another upon thermal expansion of the polymer, and the conductive carbonaceous particles having the volume resistivity of particle mass of not more than 0.05 *ohm·cm* with a compression force of from about 640 to about 960 kgf/cm$^2$ applied thereto.

2. The PTC device of claim 1, wherein the conductive particles are thermal black.

3. The PTC device of claim 1, wherein the conductive particles are mesocarbon microbeads.

4. The PTC device of claim 1, in which the conductive particles are pretreated by heating in an inactive atmosphere.

5. The PTC device of claim 4, in which the inactive atmosphere is that of nitrogen.

6. A PTC device of claim 1, in which the crystalline polymer are grafted onto the conductive carbonaceous particles, the graft being effected by thermal blending of the conductive particles and crystalline polymer in the presence of an organic peroxide.

7. In a PTC device, a PTC element comprised of a crystalline polymer mass having essentially unstructured conductive carbon particles substantially uniformly dispersed therethrough the conductive particles being separable one from another upon thermal expansion of the polymer, the conductive carbonaceous particles having the volume resistivity of particle mass of not more than 0.05 ohm·cm with a compression force of from about 640 to about 960 kgf/cm$^2$ applied thereto, the conductive carbonaceous particles being pretreated by heating it in an inactive atmosphere, with the conductive carbon particles being grafted to the crystalline polymer by thermally blending of the conductive carbon particles with the crystalline polymer in the presence of an organic peroxide.

8. The PTC device of claim 7, in which the conductive particles are thermal black.

9. The PTC device of claim 7, in which the conductive particles are mesocarbon microbeads.

10. A method for making a PTC element, comprising the steps of:

thermally treating conductive carbonaceous particles in an inert atmosphere at a temperature and for a time effective to produce a volume resistivity of not more than 0.05 ohm-cm under a compression force of from about 640 to about 960 kgf/cm$^2$, blending the conductive carbonaceous particles with a crystalline polymer in a roll mill at constant temperature to form a blended mixture.

11. The method of claim 10 in which the roll mill blending is carried out at a constant temperature of above the melting point of crystalline polymers.

12. The method of claim 10 further comprising adding an organic peroxide to the conductive particle/crystalline polymer during the roll mill blending step.

13. The method of claim 12 in which the mill blending is carried out at a constant temperature of above the melting point of crystalline polymers.

14. The method of claim 10 in which the compression mold is heated to between about 160 and about 240 degrees C. and maintained under a pressure.

15. The method of claim 10 in which following annealing, the element is subjected to radiation of gamma radiation to affect cross linking of the polymer.

16. The method of claim 10 in which the inactive atmosphere is that of nitrogen.

17. The PTC device of claim 1, wherein the conductive carbonaceous particles have a specific surface area of not more than 6 m$^2$/g.

18. The PTC device of claim 7, wherein the conductive carbon particles have a specific surface area of not more than 6 m$^2$/g.

19. The PTC device of claim 10, wherein the conductive carbonaceous particles have a specific surface area of not more than 6 $^2$/g.

* * * * *